United States Patent [19]

Romano

[11] 4,355,678

[45] Oct. 26, 1982

[54] ACOUSTIC STRIP CURTAIN

[75] Inventor: Paul L. Romano, Orange, Calif.

[73] Assignee: Acoustic Standards, Orange, Calif.

[21] Appl. No.: 240,185

[22] Filed: Mar. 3, 1981

[51] Int. Cl.[3] ..... A47H 1/00

[52] U.S. Cl. ..... 160/332; 160/327

[58] Field of Search ..... 160/40, 84 R, 84 V, 160/84 M, 184, 332, 327

[56] References Cited

U.S. PATENT DOCUMENTS

| | | | |
|---|---|---|---|
| 1,730,529 | 10/1929 | Robbins . | |
| 1,758,808 | 5/1930 | Sersen et al. . | |
| 2,233,966 | 3/1941 | Tominaga | 181/30 |
| 2,759,554 | 8/1956 | Baruch | 181/33 |
| 3,165,165 | 1/1965 | Chapman | 181/33 |
| 3,223,147 | 12/1965 | Holloway | 160/84 M |
| 3,483,944 | 12/1969 | Handy, Jr. | 181/30 |
| 3,578,105 | 3/1971 | Griff | 181/33 |
| 3,809,144 | 5/1974 | Garufo | 160/184 |
| 4,083,395 | 4/1978 | Romano | 160/84 R |
| 4,086,950 | 5/1978 | Power | 160/332 |
| 4,165,778 | 8/1979 | Smith | 160/332 |
| 4,193,474 | 3/1980 | Okubo et al. | 181/287 |

*Primary Examiner*—Peter M. Caun

*Attorney, Agent, or Firm*—Gausewitz, Carr, Rothenberg & Edwards

[57] ABSTRACT

An acoustic insulation curtain is composed of a number of long, relatively high mass optically transparent acoustic barrier sheets, having longitudinally extending central portions covered with panels of acoustic absorber material. The adjacent barrier sheets overlap one another. In some embodiments they are mutually spaced and also overlap portions of absorber panels of adjacent sheets. Absorber panels may be vertically discontinuous in a staggered relation from one panel to another to provide a circuitous sound absorbing air flow path from one side of the curtain to the other.

24 Claims, 15 Drawing Figures

FIG. 1.
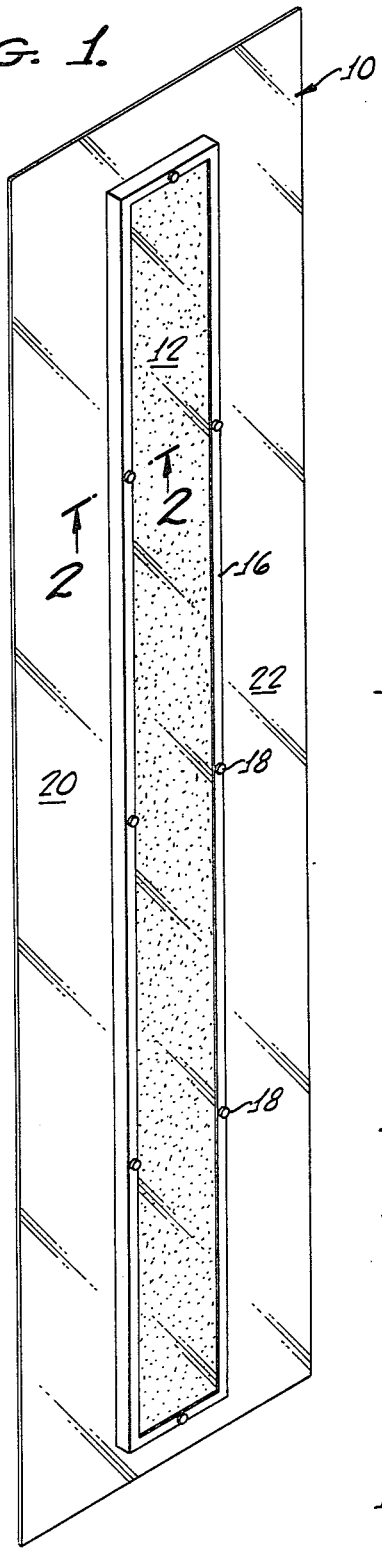
FIG. 2.
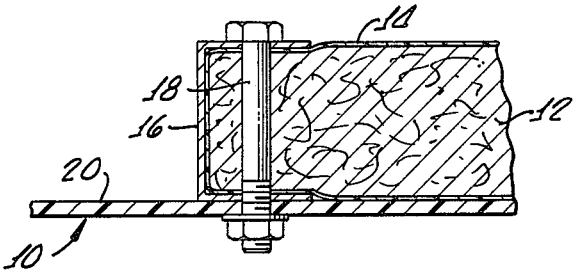
FIG. 4.
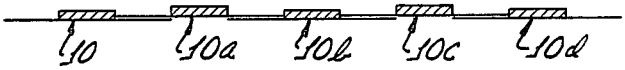
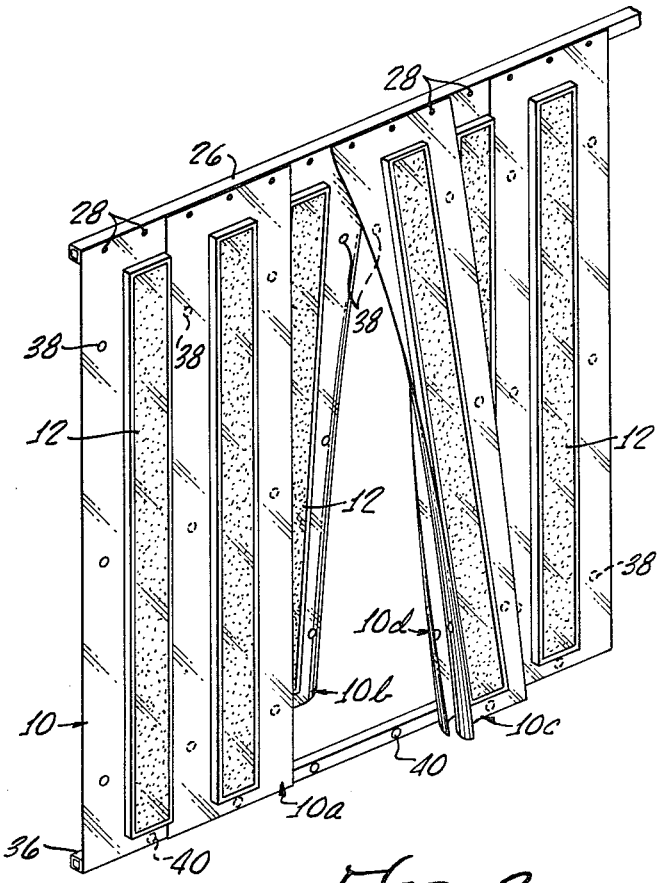
FIG. 3.

ACOUSTIC STRIP CURTAIN

BACKGROUND OF THE INVENTION

The present invention relates to acoustic isolation barriers and more particularly concerns a simple and inexpensive acoustic curtain that provides both sound transmission barrier and sound absorption.

Strip curtains composed of a number of adjacent freely hanging strips have been employed in the past to provide an enclosure surrounding an area or machine, or a closure for a doorway. Such curtains are employed to restrict air flow and to attenuate transfer of heat from one side of the curtain to the other, while permitting occasional access. People or machines moving through such curtains merely displace the freely hanging strips which are long and flexible, so that passage through the curtain is readily accomplished.

Such curtains are commonly made of high flexible material, and, having no means other than gravity to hold the strips in position, may be undesirably displaced by wind. They are readily torn or twisted and therefore fail to hang in the proper relation. Importantly such curtains provide little or no effective sound protection.

Machines located on the floor of a large manufacturing facility or otherwise in close proximity to other facilities and people, frequently create excessive noise that can be disturbing, at best, and at worst, unhealthful, for people in adjacent areas. There is a need for readily erected and inexpensive sound absorbing enclosures for such machines, enclosures which nevertheless provide both visibility and ready access. Such enclosures are desirably sound isolation enclosures. A transparent sound barrier enclosure, effective as a temporary enclosure for convention booths or noise generating industrial equipment, is described in my U.S. Pat. No. 4,083,395 for an Acoustic Drape. The arrangement of the drape of my prior patent is effective and satisfactory in many situations. Nevertheless, there is a need for a sound isolating and light transmitting enclosure of increased simplicity and decreased cost that is readily adapted to forming enclosures of different shapes and sizes and will provide for occasional access to the enclosed area.

Accordingly it is an object of the present invention to provide a simple, inexpensive and effective sound barrier system of this type.

SUMMARY OF THE INVENTION

In carrying out principles of the present invention in accordance with a preferred embodiment thereof, each of a plurality of elongated curtain strip assemblies is formed of a flexible acoustic barrier sheet and a longitudinally extending absorber panel ssecured to the sheet. The assemblies are suspended in side-by-side relation with portions of adjacent barrier sheets overlapping one another and with a laterally outer portion of one barrier sheet in close proximity to edges of the absorber panel of each adjacent sheet. Accordingly sound passing around the barrier sheet is guided in a path closely adjacent to an absorber panelinvention, the barrier sheets have overlapping portions that are mutually spaced and the panels of at least a group of mutually adjacent curtain strip assemblies are formed of longitudinally spaced panel sections, with the sections of one panel being vertically offset or staggered relative to sections of adjacent panels so as to provide a circuitous air flow path from one side of the curtain to the other.

BRIEF DESCRIPTION OF THE DRAWINGS

FIG. 1 is a pictorial illustration of a single curtain strip assembly embodying principles of the present invention;

FIG. 2 is a fragmentary section taken on line 2—2 of FIG. 1;

FIG. 3 is a pictorial illustration of a strip curtain with some of its curtain strip assemblies displaced to provide access;

FIG. 4 is a horizontal cross section illustrating the interrelation of adjacent curtain strip assemblies;

DETAILED DESCRIPTION

Figure 5:
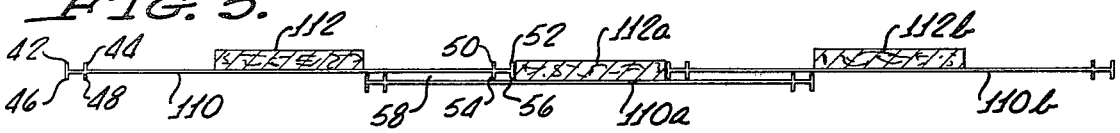
FIG. 5 is a horizontal cross section of a modified form of a strip curtain.

An acoustic strip curtain embodying principles of the present invention is made up of a number of long, relatively narrow, curtain strip assemblies of the type illustrated in FIG. 1. The curtain strip assembly comprises an acoustic barrier sheet 10, preferably formed of an optically transparent flexible plastic, such as a polyvinyl chloride, for example, having a thickness of from 40 to 130 mils. This barrier sheet has sufficient thickness and mass as to provide significant attenuation of sound passing therethrough. A long narow strip of acoustic absorption material of foam or fiberglass in the form of relatively stiff or semi-rigid acoustic absorber panel 12, is completely encased in a thin acoustically transparent and flexible material, such as a plastic sheet 14, and is rigidly secured to the barrier sheet 10 by suitable means. Preferably the plastic encased absorber panel is circumscribed by and received in a channel shaped frame 16 formed of perforated plastic or aluminum, which is bolted to the barrier sheet 10 by a plurality of bolts 18 extending through the channel walls and through the absorber panel, together with its encasing plastic 14. The absorber panel and its frame add a significant amount of stiffness to the barrier sheet and thus insure that each sheet will hang in its desired planar condition. The absorber panel covers a longitudinally extending intermediate portion of the barrier sheet, preferably the middle third, and is spaced by relatively short distances from both the top and bottom of the barrier sheet.

In a presently preferred embodiment, the barrier sheet 10 is made of 80 mil transparent polyvinyl chloride (PVC) plastic, having a length of eight feet and a width of 2 feet. The absorber panel, together with its frame 16, has a width of eight inches and is centrally positioned on the barrier sheet so as to provide longitudinally extending lateral sections 20,22 of the barrier sheet, each having a width of 8 inches. The top of the absorber panel is spaced below the top of the barrier sheet by a distance of three to four inches.

As illustrated in FIG. 3, to form an acoustic strip curtain of the described curtain strip assemblies, a fixed overhead support, such as, for example, a rectangular section steel, aluminum or wood bar or runner 26 is fixed in a desired location and a number of the described strip curtain assemblies are bolted or otherwise secured to one side of runner 26, by fastening devices such as bolts 28.

Figure 9:
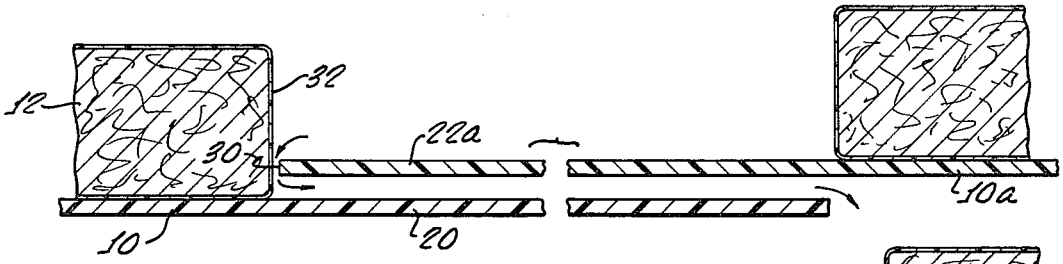
FIG. 9 is an enlarged detail of the curtain of FIGS. 3 and 4.

It is important to note that the barrier sheets are positioned in side-by-side relation such that each outer section 20 and 22 of each barrier sheet overlaps for its full length and width the corresponding outer section of each adjacent barrier sheet. This full width overlapping arrangement, as can be best seen in FIGS. 4 and 9, positions the laterally outermost edge 30 of an outer section 22*a* of one barrier sheet 10*a* close to a lateral edge 32 of the absorber panel 12 of the adjacent sheet 10. More particularly, edge 30 is positioned adjacent the central portion of the channel shaped frame which mounts the absorber panel, such frame being relatively thin and perforated so as to have little resistance to the transmission of sound therethrough.

For improved ease of access (passage of persons through the curtain) each barrier sheet has only one of its surfaces or sides in contact with overlapping adjacent barrier sheets. The sheets are not positioned in a shingle-like relation where one surface of one lateral outer section contacts one adjacent sheet and the opposite surface of its other lateral outer section contacts the other adjacent sheet. Thus, as illustrated in FIG. 3, any single curtain strip assembly may be displaced outwardly, to one side of the curtain, entirely independently of and without disturbing any other barrier sheet.

As can be seen in FIG. 4, alternate panels 10*a* and 10*c* of a series of barrier sheets 10, 10*a*, 10*b*, 10*c* and 10*d*, have both outer edges in close proximity to or in abutment with corresponding side edges of the absorber panels of both adjacent barrier sheets. With this arrangement an efficient and effective sound transmission barrier is provided by three different mechanisms. The absorber panels 12 themselves provide a significant amount of absorption of impinging sound. The barrier sheets, because of their mass, reflect rather than transmit sound impinging thereon and moreover, where the barrier sheets are not backed by an absorber panel, they are of double thickness and may have an air space therebetween as will be described below. Sound that cannot be transmitted through the absorber panel or barrier sheet may tend to travel through the curtain from one side to the other via the joints between the adjacent strip assemblies. Because of the configuration of overlapping lateral sections of barrier sheets and the positioning of barrier sheet edges in proximity to absorber panels, sound passing through the joints between such adjacent strip assemblies must travel around the edges 30, of the barrier sheets in close proximity to the absorber panel 12, and thus the described configuration will direct such sound through perforated channel 16 to the absorber sheet where a significant amount of absorption occurs.

In many applications, the curtain strip assemblies will be secured only at their top, as by bolts 28 or the equivalent and the assemblies will hang properly in close proximity and in the desired relative positioning. This curtain provides visibility from one side to another through the double thicknesses of the transparent barrier sheets (between adjacent absorber panels). It provides significant sound absorption and reflection as previously described and also provides for ready access or passage through the curtain of persons and machines, merely by pushing aside several of the adjacent strips. The barrier sheets being secured solely at their top edges, being flexible, and being rigidified by the semi-rigid absorber panels which terminate several inches from the points of top edge securement of the sheets, will readily flex and twist to allow such passage. Nevertheless, in some situations it may be desirable to temporarily secure several strips to each other or to a lower fixed bar 36 that is substantially similar to upper bar 26. For such detachable connection of one curtain strip assembly to the next, detachable fastening devices, such as snap fasteners 38, may be provided on and between facing overlapping outer barrier sheet sections. If deemed necessary or desirable, lower edges of the curtain strip assemblies may be secured to the lower support 36 as by still other detachable fasteners, such as snap fasteners 40, (FIG. 3) or by capturing the bottom ends of the barrier sheets in an upwardly open element (not shown in FIG. 3), of the type illustrated in FIGS. 14 and 15. Detachable fastening devices known under the trademark Velcro may also be employed. Such fasteners would be used where access is infrequent. Thus for occasional access, one would merely have to detach the fasteners holding just a few of the adjacent curtain strip assemblies so as to push these aside for passage.

Figure 6:
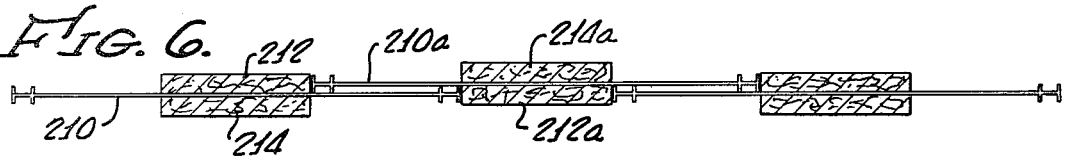
FIG. 6 is a horizontal section of still another modified form of curtain.

Illustrated in FIG. 5 is a modification of the curtain strip assemblies of FIG. 6. In the arrangement of FIG. 5, the curtain strip assemblies each comprise a barrier sheet 110, 110*a*, 110*b*, 110*c* and 110*d*, made of the same material and overall configuration as barrier sheet 10 and mounting an absorber panel 112, 112*a*, 112*b*, 112*c* and 112*d*, centrally positioned and bolted thereto, in the manner described in connection with FIGS. 1–4. In the arrangement of FIG. 5, to enhance the sound insulation, to further stiffen the barrier sheet and to improve the relative positioning of the barrier sheets, each of the sheets is formed with a pair of longitudinally extending spaced ribs 42,44 on one surface and a similar pair of ribs 46,48 on the other surface of the barrier sheet. Identical pairs of ribs 50, 52, 54 and 56 are formed on the opposite surfaces of the other side of the barrier sheet. The endmost ribs, such as ribs 52, 56 provide an edge for the barrier sheet having a width equal to the thickness (approximately one inch in a preferred embodiment) of the absorber panel. These ribs are coextensive with and are positioned in abutment with or in close proximity to the edge of the absorber panel of an adjacent assembly. The ribs such as ribs 46, 48, 54, 56 on inner surfaces of the barrier sheets (i.e., those surfaces facing the overlapping sections of adjacent barrier sheets), form barrier sheet spacers, providing an air space 58 between the mutually facing inner surfaces of adjacent barrier sheets, such as sheets 110 and 110*a* for example. This spacing itself enhances the resistance to sound passage through the curtain. Further, the increased width of the barrier sheet edge as provided by a pair of oppositely extending ribs 52, 56 increases that portion of the sound path around the barrier sheet edges which is adjacent to the absorber panel, and thus increased absorption is achieved. Preferably each of the ribs extends substantially the full length of the barrier sheet and may be molded integrally therewith or otherwise fixedly secured thereto. It is preferred that the ribs be made of the same material as the barrier sheet.

In still another modification, as illustrated in FIG. 6 and momentarily ignoring absorber panels 214, 214*a*, the curtain strip assemblies are still all identical to one another, but are turned around, or end for end, so that an absorber panel 212 of one barrier sheet 210 is on the inner surface of the sheet and the adjacent absorber panel 212*a* is also on the inner surface of its barrier sheet 210*a*. The absorber panels 212 and 212*a* are actually on different sides of the curtain, facing in opposite directions. In the arrangement of FIGS. 4 and 5 on the other hand, the absorber panels are all on the same side of the curtain. The arrangement of FIG. 6 is readily adapted to provide for sound absorption on both sides of the curtain. One or more of the barrier sheets 210, 210*a* may be provided with a second absorber panel, indicated at 214, 214*a*, identical to the earlier described absorber panel, together with its framing and securement, and placed directly opposite the first panel of the barrier sheet but on the other surface thereof.

Figure 10:
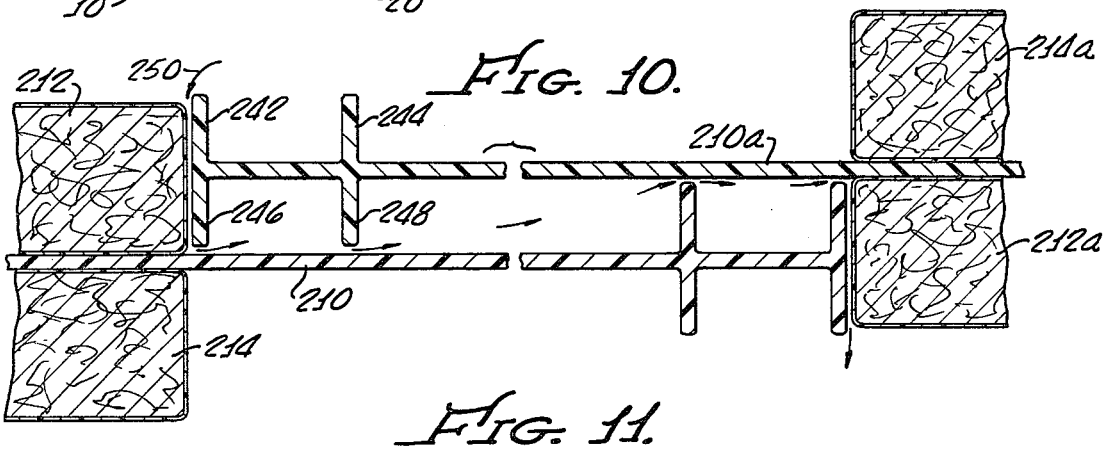
FIG. 10 is an enlarged fragmentary detail of the curtain of FIG. 6.

FIG. 10 is an enlarged fragmentary section of the strip curtain of FIG. 6 showing ribs 242, 246 and 244, 248 on the end of the outer section of barrier sheet 210*a*. The outermost ribs 242, 246 form an enlarged edge of the barrier sheet coextensive with the thickness of panel 212 and direct sound passing through the joints along the paths indicated by arrows 250. It can be seen that sound must pass through the space between the enlarged edge of the barrier sheet 210*a* and the edge of absorber panel 212 and also through a similar narrow space between the enlarged edge of barrier sheet 210, and the edge of panel 212*a*, thereby to increase the sound absorption.

Figure 7:
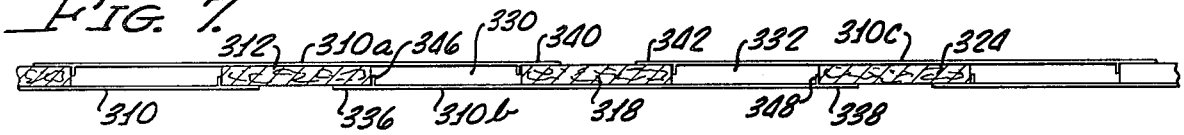
FIG. 7 is a horizontal cross section of still another embodiment.
Figure 8:
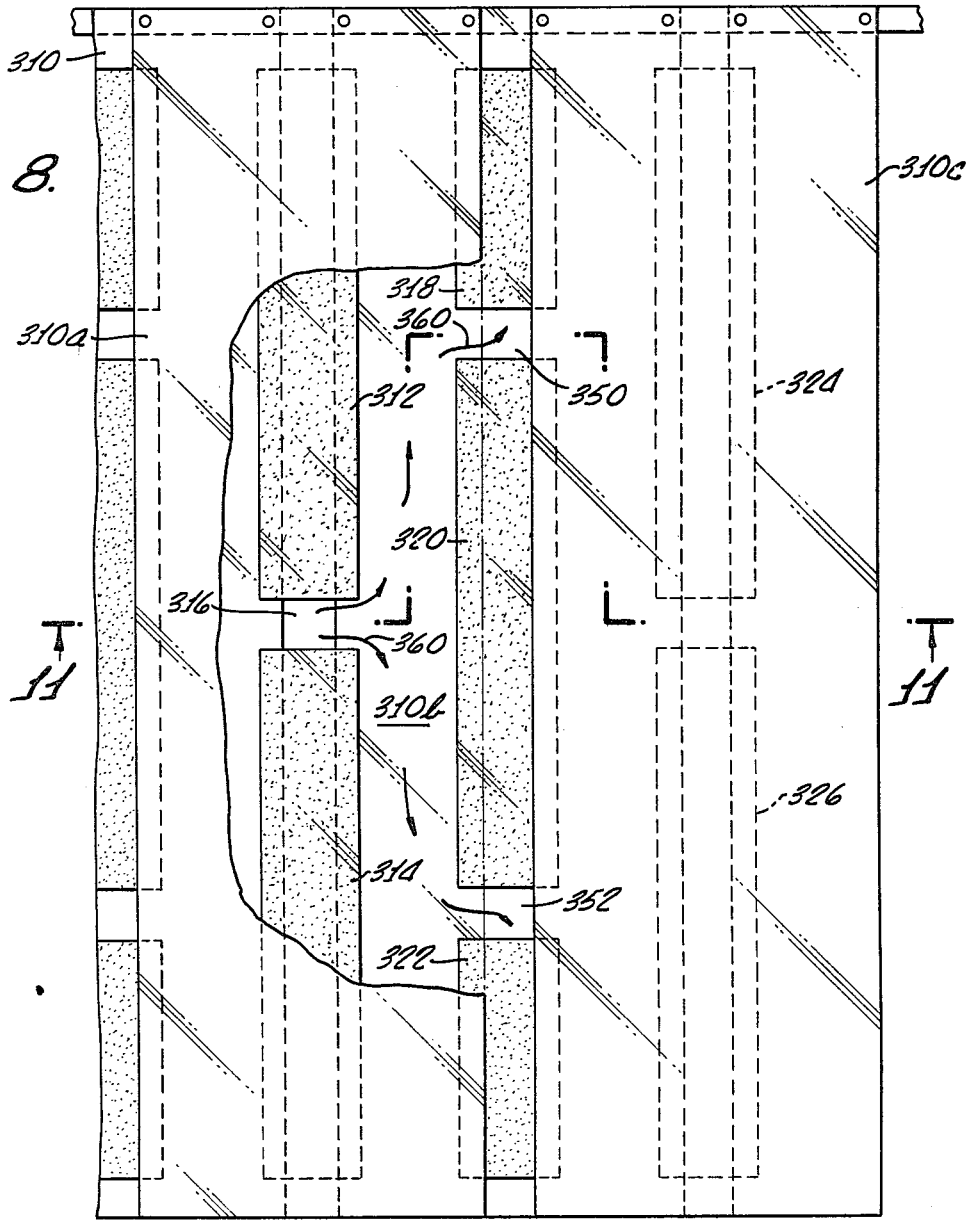
FIG. 8 is a vertical elevation, with parts broken away, of parts of the curtain of FIG. 7.
Figure 11:
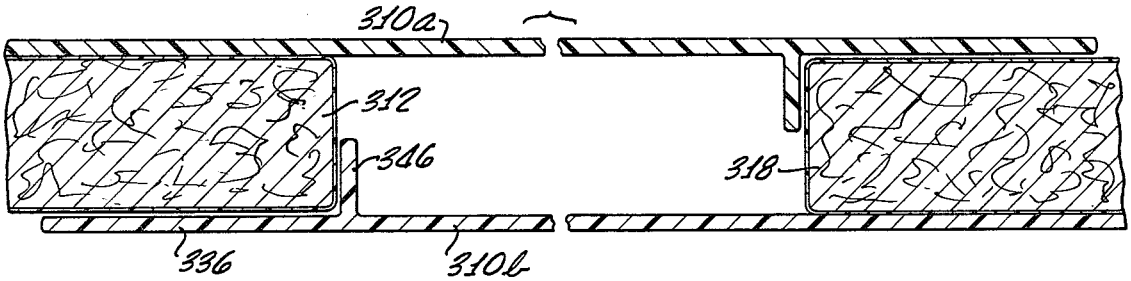
FIG. 11 is an enlarged fragmentary detail of the curtain of FIGS. 7 and 8.
Figure 13:
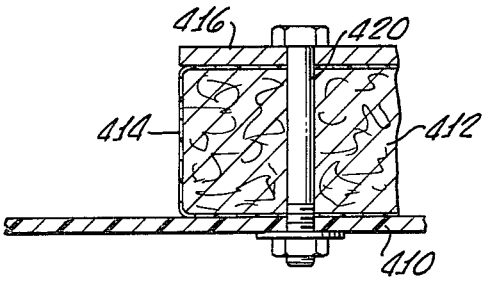
FIG. 13 is a section taken on line 13—13 of FIG. 12.
Figure 12:
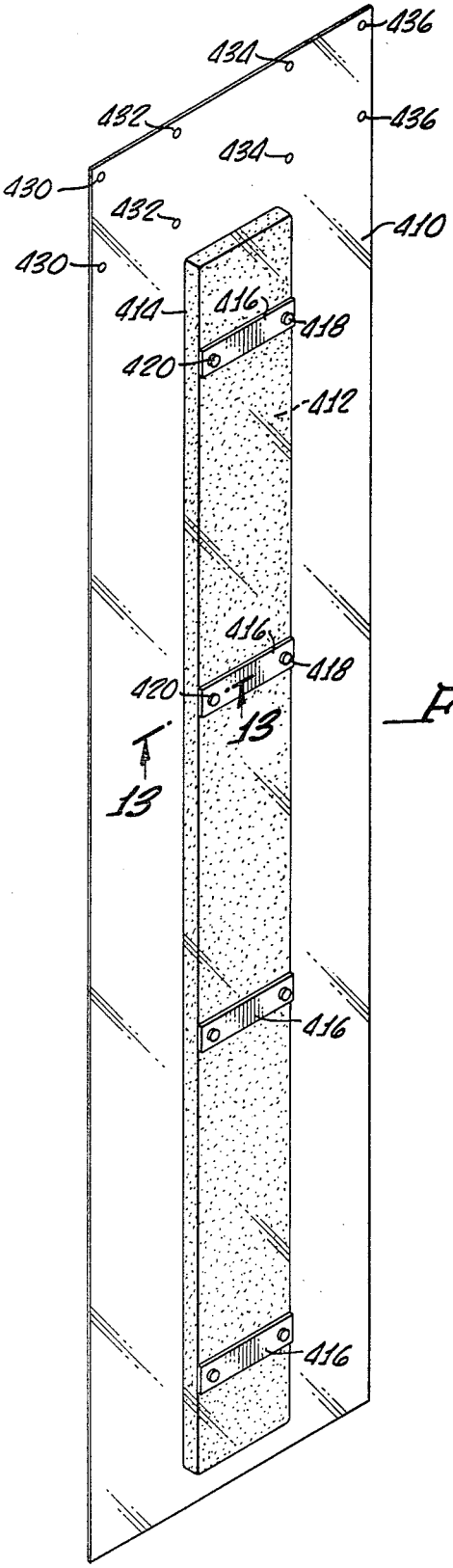
FIG. 12 illustrates a portion of a modified curtain strip assembly.

Illustrated in FIGS. 7, 8 and 11 is still another embodiment of the strip curtain, an embodiment that is particularly arranged to provide visibility, sound isolation, ready access and yet also provide a degree of air flow through the curtain. In this arrangement, the curtain includes barrier sheets 310, 310*a*, 310*b*, 310*c*, etc. Upon barrier sheet 310*a* are mounted two acoustic absorber panel sections 312, 314 (FIG. 8) the sections being vertically elongated and vertically spaced from one another to provide a single discontinuous absorber panel having a space 316 between the adjacent sections thereof. Adjacent absorber sheet 310*b* is also formed with vertically discontinuous absorber panels, there being three longitudinally spaced absorber panel sections 318, 320 and 322. Absorber panel sections of barrier sheet 310*b* are on the inner surface of this sheet, facing toward one side of the curtain, whereas the absorber panels 312,314 of barrier sheet 310*a*, are on the inner surface of this sheet, facing to the other side of the curtain. The next curtain strip assembly in the sequence includes a barrier sheet 310*c* and a pair of vertically spaced longitudinal absorber panel sections 324, 326, making this assembly identical to and oriented in the same manner as the assembly of barrier sheet 310*a* and its two absorber panel sections 312,314. Adjacent curtain strip assemblies continue to alternate along the curtain in this manner so that the vertically discontinuous absorber panel sections of one curtain strip assembly are vertically offset or staggered with respect to the discontinuous absorber panel sections of each adjacent section on either side thereof.

Not only are the absorber panel sections staggered from one curtain strip assembly to the next, but overlapping sections of the barrier sheets are mutually spaced to provide an air space therebetween such as indicated at 330 and 332, in FIG. 7. Spacing of the barrier sheets is provided by making each of these barrier sheets wider than the barrier sheets in the previously described embodiments or, alternatively, by increasing the overlapping portion of the barrier sheets to cause the outer sections of the sheets to overlap both corresponding outer sections of adjacent barrier sheets as in prior embodiments, and a small portion of the absorber panel sections of adjacent curtain strip assemblies. Thus, as can be seen in FIGS. 7 and 8, barrier sheet 310*b* has an outermost section 336 that overlaps lateral portions of absorber panel sections 312 and 314 and has a similar overlapping section 338 on the other side of this barrier sheet overlapping absorber panel sections 324,326. Similarly, barrier sheets 310*a* and 310*c* have outermost sections 340,342, respectively, that overlap laterally outer portions of absorber panel sections 318, 320 and 322. To help position the barrier sheets and absorber panels of adjacent curtain strip assemblies in the desired relation, each barrier sheet, adjacent its outermost panel overlapping portions, has an inwardly extending, longitudinally extending rib, such as ribs 346,348 of barrier sheet 310*b* adjacent outer barrier sheet sections 336,338 respectively. These ribs abut or lie closely adjacent the edges of the absorber panel sections of the adjacent curtain strip assemblies as can be best seen in the enlarged fragmentary view of FIG. 11. The ribs not only help laterally locate curtain strip assemblies relative to one another, but also enhance the absorption of sound passing through the curtain via the joints between adjacent strip assemblies, all as described above in connection with other embodiments.

The arrangement shown in FIGS. 7, 8 and 11 allows air to flow from one side of the curtain to the other in a circuitous path between and along adjacent absorber panel sections and between mutually spaced overlapping barrier sheets. Thus, for example, air can flow in the path indicated by the arrows 360 in FIG. 8, flowing into one side of the curtain, for example, through the space 316 between absorber panel sections 312 and 314 and between the adjoining edges of barrier sheets 310 and 310*b*. The air can flow thence both upwardly and downwardly in the space between overlapping portions of barrier sheets 310*a* and 310*b* to the spaces 350 and 352 between longitudinally spaced absorber panel sections 318, 320 and 322, and between the adjoining edges of barrier sheets 310*a* and 310*c*. Thus, although the air can flow through the curtain, it is forced in a circuitous path along the absorber panel sections which provides for significant amounts of absorption in this passage. Further, as described above, the spaces, such as spaces 330 and 332, between overlapping sections of adjacent barrier sheets provide an airspace to further enhance resistance to passage of sound through the curtain.

Illustrated in FIGS. 12–15 is a modified curtain strip assembly arrangement. As illustrated in these figures, an absorber panel section 412 is encased in a thin sound transparent sheath 414, but no perimetral frame is provided. Instead, a plurality of longitudinally spaced strips 416 are provided, extending across the sheathed absorber panel and bolts 418, 420 extend through the strap 416 through the sheathed panel 412,416 and through the barrier sheet 410 to firmly secure the sheathed absorber panel to the sheet.

In this embodiment the barrier sheet 410 is extended at its topmost portion, and four laterally spaced pairs of vertically spaced holes 430, 432, 434 and 436 are provided. The holes are all on the outer one-third or outer longitudinal sections of the barrier sheets. The sheets are hung from an overhead support rod 440 (FIGS. 14 and 15) by looping the uppermost portions of the sheets, above the absorber panels 412, over the bar to mate and align the holes of each hole pair 430, 432, etc. After securing a first barrier sheet 410 by means of bolts 442,444 through holes 430,432 second and third curtain strip barrier sheets 410*a* and 410*b* are placed in overlapping relation and their uppermost portions are then looped over the support rod 440 with a laterally outer section of barrier sheet 410*a* overlapping the corresponding outer section of the previously placed barrier sheet 410. Bolt holes on the left lateral section of barrier sheet 410*a* are aligned with bolt holes on the overlapped right lateral section of barrier sheet 410. Until this time, that section of sheet 410 that is to be overlapped by the adjacent sheet 410*a* has not been secured to the support rod 440. After sheet 410*a* is looped over the bar 440 and is overlapping the longitudinal ssection of barrier sheet 410 bolts 446,448 are passed through holes 434,436 of sheet 410 and also through the aligned holes of sheet 410*a*, whereby the two bolts 446,448 will secure the loops of laterally longitudinal sections of two adjacent barrier sheets. Thus each uppermost end portion of a barrier sheet extends over the bar to form a loop substantially encircling the bar with the free end of the sheet extending downwardly and overlapping a portion of the upper end of the sheet so that the holes of a single pair, such as a pair 430, are coaxially aligned for reception of a singlle bolt. Loops of adjacent sheets overlap one another, and each of the four bolts securing the loop of any intermediate sheet also secure the loop of an adjacent sheet on either side of the intermediate sheet.

This arrangement of hanging the curtain strip assemblies by means of loops and preformed bolt holes is applicable to any of the barrier sheet arrangements previously described. For those barrier sheets having stiffening ribs, loops may be readily formed if the ribs are omitted from the uppermost portions of each sheet. With this arrangement no holes need be drilled in the field during installation of the curtain. The field effort is considerably facilitated since all of the holes are preformed in the sheet. Further, the coaxially aligned holes of any one sheet help to appropriately position the curtain strip assembly, insuring that it will hang in a proper vertical position. The alignment of holes of one sheet with holes of an adjacent sheet insures proper relative lateral position of adjacent sheets. Thus the sheets are more readily installed with barrier sheet edges close to or abutting edges of absorber panels of adjacent strip assemblies.

Figure 14:
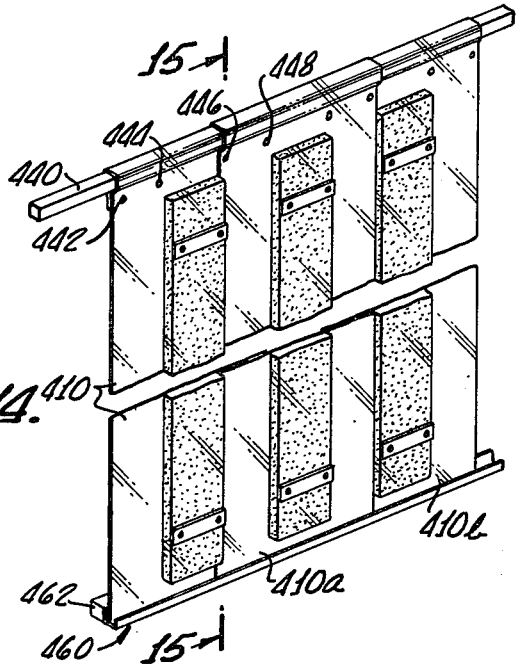
FIG. 14 illustrates a curtain composed of strip assemblies of FIGS. 12 and 13.
Figure 15:
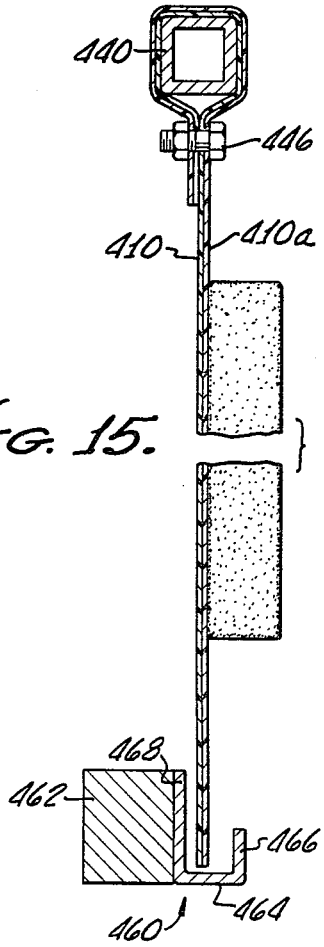
FIG. 15 is a section taken on lines 15—15 of FIG. 14.

Also illustrated in FIGS. 14 and 15 is an alternate and presently preferred arrangement for positioning and restraining the lower ends of suspended curtain strip assemblies. In this arrangement an upwardly open channel 460 is fixedly positioned at the bottom of the curtain by any suitable means, such as, for example, by securement to a fixed bottom bar 462. Channel 460 is formed with a web 464, an outer channel leg 466, and an inner channel leg 468. The lowermost end of the curtain strip assemblies hang downwardly within the channel, being captured and very loosely confined between legs 466 and 468. Preferably, leg 466 on the outer side of the curtain (outwardly of an enclosure of which the curtain may form a part) has a shorter vertical extent from web 464 than does the inner channel leg 468. Accordingly, to release any one or more curtain strip assemblies from its loose confinement within the channel, the lower end of the strip assembly need merely be displaced outwardly (independently of adjacent strip assemblies) over the upper edge of the shorter leg 466. To return the strip assembly to its normal substantially vertical position, the strip assembly is merely pushed inwardly (toward the left as viewed in FIG. 15) until the lower edge is again loosely captured within the channel. The greater vertical extent of inner channel leg 468 helps to prevent the strip assemblies from being inadvertently displaced beyond the channel and over this inner leg 468.

It will be readily understood that in all of the embodiments described herein, each curtain strip assembly may be secured to an upper support bar similar to bar 26 of FIG. 3, in the manner illustrated in FIG. 3 or FIG. 15. Further, in all of the described embodiments, if deemed necessary or advisable, separable fastening devices, such as Velcro or snap fasteners or the like, may be provided to secure the barrier sheets at their bottom to a similar fixed member and to secure the barrier sheets to each other or to the absorber panels of adjacent curtain strip assemblies. Alternatively a strip retaining channel like channel 460, may be used with any of the described embodiments.

Instead of using straps 416, sheathed absorber panels may be directly bolted to the barrier sheet 410, employing large washers to distribute the forces of the bolt to the foam or fiberglass absorber material.

There have been described various types of acoustic strip curtain assemblies which provide simple and inexpensive, reliable and long lasting mounting arrangements requiring no slidable connections and yet provide access, visibility and a highly effective sound barrier.

The foregoing detailed description is to be clearly understood as given by way of illustration and example only, the spirit and scope of this invention being limited solely by the appended claims.

What is claimed is:

1. An acoustic strip curtain comprising a plurality of elongated curtain strip assemblies secured to and suspended from a support, all assemblies of a group of said assemblies hanging in side-by-side relation, each assembly of said group comprising a flexible acoustic barrier sheet having first and second longitudinally extending outer sections and a longitudinally extending inner section, an absorber panel of acoustic absorber material secured to said inner section of said sheet and extending longitudinally thereof, said panel having a thickness greater than the thickness of said sheet and having laterally facing longitudinally extending edges, each outer section of a group of said barrier sheets overlapping an outer section of an adjacent sheet for substantially the entire length and width of such outer sections, and each sheet of said group having a longitudinally extending edge portion positioned adjacent an edge of the panel of an adjacent assembly of said group, whereby sound passing between overlapping outer sections passes around an edge of a barrier sheet in proximity to an absorber panel.

2. The curtain of claim 1 wherein facing surfaces of overlapping sheet sections are spaced from each other, and wherein each said absorber panel is vertically discontinuous to provide panel sections with discontinuities therebetween, discontinuities of one panel being vertically staggered relative to discontinuities of adjacent panels, thereby to provide a circuitous air flow path around and along said absorber panel sections from one side of said curtain to the other.

3. The curtain of claim 1 including means for spacing surfaces of overlapping outer sections from each other to provide an air space therebetween.

4. The curtain of claim 1 wherein at least some of said outer sections overlap a portion of the absorber panel of an adjacent curtain strip assembly to provide an air space between overlapping outer sections.

5. The curtain of claim 4 including longitudinally extending inwardly projecting ribs on at least some of said outer sections positioned adjacent an edge of the panel of an adjacent curtain strip assembly.

6. The curtain of claim 1 including releasable fastening means for detachably connecting at least some of said adjacent curtain strip assemblies to one another.

7. The curtain of claim 1 including a fixed bottom member, and releasable fastening means for detachably connecting at least some of said curtain strip assemblies to said fixed bottom member.

8. The curtain of claim 7 wherein said fastening means includes an upwardly open channel on said fixed bottom member, lower edges of said strip assemblies being captured in said channel.

9. The curtain of claim 1 wherein absorber panels of adjacent curtain strip assemblies are on the same side of said barrier sheets.

10. The curtain of claim 1 wherein the absorber panels of adjacent curtain strips are on opposite sides of their barrier sheets.

11. The curtain of claim 1 wherein only one side of each barrier sheet is in overlapping contact with the opposite side of each adjacent barrier sheet, whereby each barrier sheet may be swung outwardly to be displaced from adjacent barrier sheets independently of displacement of such adjacent barrier sheets.

12. The curtain of claim 1 wherein at least some of said barrier sheets have absorber panels on both sides.

13. The curtain of claim 1 wherein at least some of said absorber panels are individually encased in acoustically transparent material and bolted to said barrier sheets.

14. The curtain of claim 1 wherein some of said barrier sheets are optically transparent.

15. An acoustic strip curtain comprising a plurality of elongated curtain strip assemblies, each said assembly comprising a flexible acoustic barrier sheet, and an absorber panel secured to an intermediate area of said sheet and extending from upper to lower portions thereof, means for suspending said assemblies to hang in side-by-side relation with portions of adjacent barrier sheets overlapping one another and with laterally outer portions of one barrier sheet in close proximity to edges of the absorber panel of each adjacent barrier sheet, whereby sound passing around the barrier sheets is guided in a path closely adjacent to an absorber panel.

16. The curtain of claim 15 including an upwardly open channel mounted at and extending along the bottom of said strip assemblies, lower ends of at least a group of said strip assemblies hanging within said channel thereby to releasably retain the lower ends of said strip assemblies.

17. The curtain of claim 15 wherein only one side of each barrier sheet is in contact with overlapping adjacent barrier sheets, whereby each sheet can be outwardly displaced without displacing an adjacent overlapping sheet.

18. The curtain of claim 15 wherein the laterally outer portion of some of the barrier sheets extend inwardly along an edge of the absorber panel of adjacent barrier sheets toward adjacent overlapping barrier sheets.

19. The curtain of claim 15 wherein absorber panels of adjacent barrier sheets are on opposite sides of such sheets, and wherein said overlapping barrier sheet portions are mutually spaced.

20. The curtain of claim 19 including means on said overlapping portions of at least some of said barrier sheets for spacing such portions from one another.

21. The curtain of claim 19 wherein said overlapping barrier sheet portions also overlap edge portions of the absorber panels of adjacent barrier sheets.

22. The curtain of claim 15 wherein said overlapping barrier sheet portions are mutually spaced, and wherein the panels of at least a group of mutually adjacent curtain strip assemblies each comprises a plurality of longitudinally spaced panel sections, the sections of one panel being vertically offset relative to the sections of adjacent panels to provide a circuitous air flow path from one side of the curtain to the other, between sections of a single panel and between overlapping barrier sheet portions.

23. The curtain of claim 15 wherein said means for suspending said assemblies comprises a support bar, each sheet having an upper end extending over said bar to form a loop substantially encircling the bar with the free end of the sheet extending downwardly and overlapping a portion of the sheet, each loop of an intermediate sheet overlapping the loops of adjacent sheets on either side of such intermediate sheet and secured thereto.

24. The curtain of claim 23 wherein said loops are secured to adjacent loops by fasteners each extending through free ends and overlapped portions of upper ends of two adjacent sheets whereby said fasteners secure the sheet loops, secure each sheet to its adjacent sheets at upper ends thereof, and position the sheets relative to the support bar and relative to one another.

* * * * *

UNITED STATES PATENT AND TRADEMARK OFFICE

CERTIFICATE OF CORRECTION

PATENT NO. : 4,355,678

DATED : Oct. 26, 1982

INVENTOR(S) : Paul L. Romano

It is certified that error appears in the above-identified patent and that said Letters Patent are hereby corrected as shown below:

Column 1, line 63, after "panel", insert --- and is at least partly absorbed thereby. According to another feature of the ---.

In claim 3 (column 9, line 12), after "spacing", insert ---facing---.

Signed and Sealed this

*Fifth* Day of *April 1983*

[SEAL]

*Attest:*

GERALD J. MOSSINGHOFF

*Attesting Officer*

*Commissioner of Patents and Trademarks*